United States Patent [19]

Hürzeler et al.

[11] 3,978,695

[45] Sept. 7, 1976

[54] APPARATUS FOR DYEING A TRAVELLING STRIP SUCH AS YARN

[75] Inventors: René Hürzeler, Winterthur; Paul Lincke, Zell, both of Switzerland

[73] Assignee: Sulzer Brothers Limited, Winterthur, Switzerland

[22] Filed: Mar. 24, 1975

[21] Appl. No.: 562,655

[30] Foreign Application Priority Data

Mar. 29, 1974 Switzerland ..... 4406/74

[52] U.S. Cl. ..... 68/20; 68/200; 68/DIG. 1; 118/63; 118/325; 118/DIG. 21

[51] Int. Cl.[2] ..... D06B 1/04

[58] Field of Search ..... 68/DIG. 1, 19, 5 D, 68/5 E, 6, 20, 181 R, 183, 200, 205 R, 175; 28/1.4, 75 R, 75 WT; 118/62, 63, 325, DIG. 18, DIG. 21

[56] References Cited

UNITED STATES PATENTS

| | | | |
|---|---|---|---|
| 3,077,859 | 2/1963 | Cook | 118/325 X |
| 3,391,551 | 7/1968 | Hasler et al. | 68/200 X |
| 3,727,275 | 4/1973 | Ohayon | 28/1.4 |

*Primary Examiner*—Philip H. Coe
*Attorney, Agent, or Firm*—Kenyon & Kenyon Reilly Carr & Chapin

[57] ABSTRACT

The dyeing apparatus effects a programmed dyeing pattern on the travelling strip. This apparatus includes a housing provided with a through channel for passage of the travelling strip through a treatment station in the housing. Treatment medium such as a dye is delivered to the treatment station via a channel perpendicular to the strip. In addition, compressed air is delivered to the treatment station via a funnel-shaped channel downstream of the station to remove excess dye from the yarn and to obtain a clean well-defined dyed area on the strip. A similar funnel-shaped channel upstream of the treatment station serves to seal the elongated channel against the treatment medium. Also, an exhaust channel is provided to remove excess treatment medium and air.

13 Claims, 4 Drawing Figures

APPARATUS FOR DYEING A TRAVELLING STRIP SUCH AS YARN

This invention relates to an apparatus for dyeing a travelling strip, and particularly, for dyeing a yarn or thread delivered to a loom or a knitting machine. Still more particularly, this invention relates to an apparatus for dyeing strips of material in a programmed manner.

Various types of equipment have been known for the dyeing of strip materials including yarns and threads in a piece-by-piece manner. In one known case, for example as described in German Patent 146,041 a yarn to be dyed and processed as a weft yarn in a loom is conducted through a container filled with dye liquid between a supply spool outside a loom-shed and the place where the yarn enters the fabric. The dyed yarn leaves that container more or less wet and, in that condition, is brought into the loom-shed. In addition, the yarn is dyed along its entire length, so that no production of patterns by the dyeing process is possible.

Other types of devices have also been suggested, as described in German Patents 412,360 and 673,792 wherein the yarn to be worked in a knitting machine is conducted past a dyeing roller and is rhythmically imprinted with the colored pattern to be produced, or is dyed or impregnated.

These known devices, however, are relatively complicated, and take up much space. The devices are also not suitable for a treatment of the material (the following assumes as an example the dyeing of yarn) in short and definitely limited spacings for the purpose of obtaining an exact pattern or the like.

Another device is also known from U.S. Pat. No. 3,391,551 in which a dyestuff is intermittently applied at a treatment station to a yarn moving through a passageway in a housing. In this case, a feed conduit forms a junction with the passageway and the junction constitutes the treatment station. The dyestuff is controlled by a valve which intermittently connects a low pressure source to the feed conduit. However, in this case, the dyestuff applied to the yarn may smear in the treatment station with the result that the pattern imposed on the yarn is not sharply defined. This can be of particular concern where the yarn is to be subjected to a sequence of dyeing operations in which different patterns are to be imposed on the yarn.

Accordingly, it is an object of the invention to provide an apparatus for dyeing a travelling strip in a clean well-defined manner.

It is another object of the invention to provide an apparatus for dyeing travelling strips such as yarns and threads in a sequence of programmed steps.

It is another object of the invention to provide a simple apparatus for dyeing yarn throughout the cross-section of the yarn.

Briefly, the invention provides an apparatus for dyeing a travelling strip having a channel for passage of the strip through a treatment station, at least one channel having an outlet for supplying a treatment medium to the treatment station in a programmed manner, and at least one channel downstream of the treatment station for supplying compressed air to the treatment station for removing excess treatment medium from the strip.

In this way, it is possible to obtain a particularly well-controlled supply of dye, capable of dyeing the strip all around as well as interiorly.

In one advantageous arrangement, the treatment medium supply channel is set about perpendicularly of the channel through which the material strip, for example a yarn, is conveyed, two funnel-shaped annular channels for supplying compressed air are positioned upstream and downstream of the treatment station, and an exhaust channel is set perpendicular to the strip-conveying channel. The upstream funnel-shaped channel has an outlet at the apex and at the outlet of the supply channel in order to supply the compressed air to seal the strip-conveying channel upstream of the treatment station against the treatment material. The downstream funnel-shaped channel has an outlet at the apex which is also located at the outlet of the supply channel for supplying the compressed air to the treatment station. The exhaust channel serves to remove excess treatment material and air from the treatment station and, to this end, has an inlet disposed between the outlets of the funnel-shaped channels.

As found from tests, it is possible to precisely ensure that the supplied dyeing liquid goes all round the yarn for a sharply delimited distance and impregnates the yarn. The dyeing liquid moreover does not tend to form small drops upon any laterally extending fibers of the yarn, leaving the fibers themselves more or less undyed.

For these reasons, the apparatus of the invention is particularly suitable for dye-patterning yarn in rapid sequences of a specified program, usually working synchronously with a following machine, e.g. a knitting machine or a loom.

These and other objects and advantages of the invention will become more apparent from the following detailed description and appended claims taken in conjunction with the accompanying drawings in which:

Figure 1:
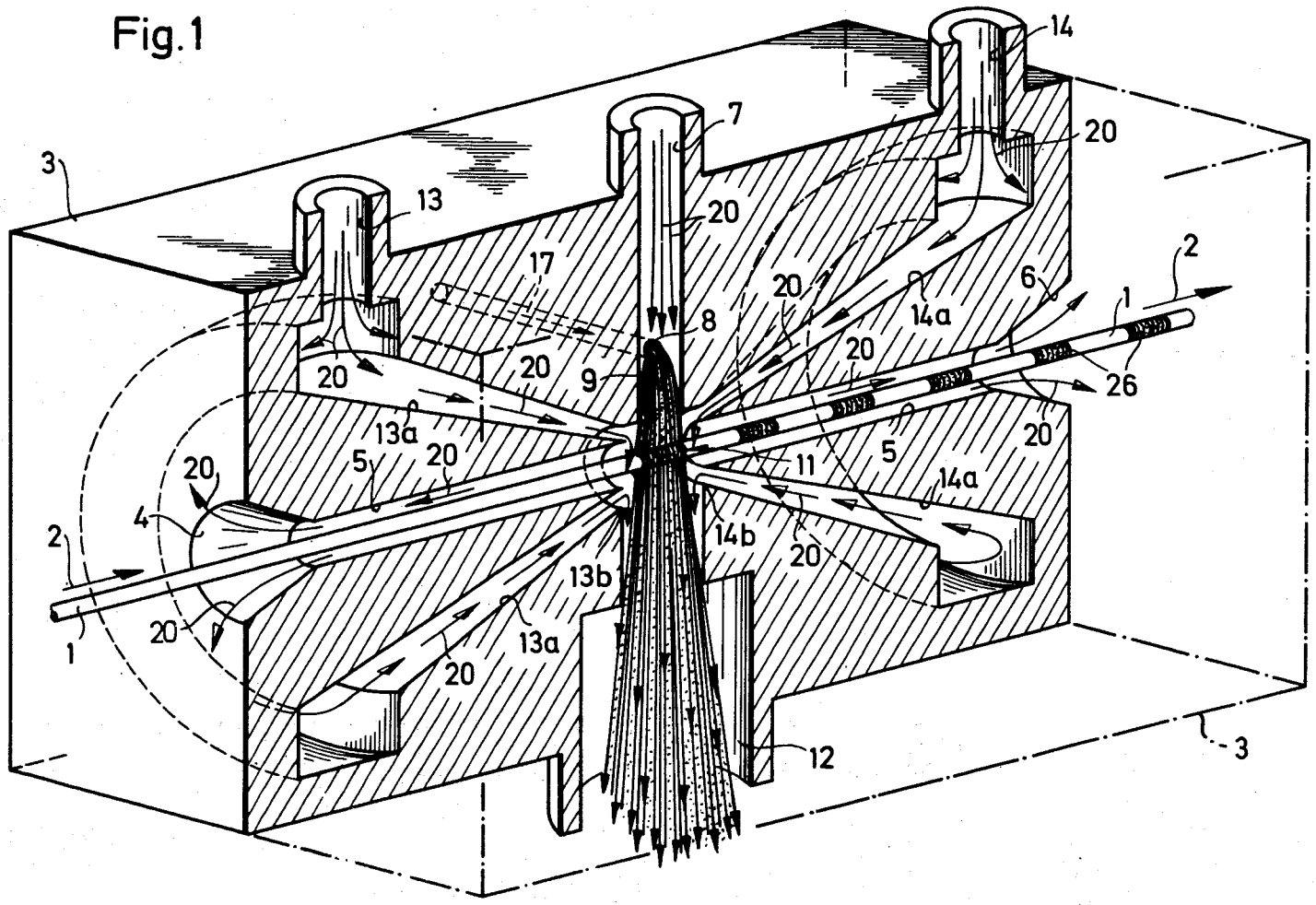
FIG. 1 illustrates a perspective view of a dyeing apparatus in accordance with the invention.

Referring to FIG. 1, the apparatus for dyeing a strip of material, such as a yarn 1 which runs in the direction of arrow 2, continuously or intermittently (e.g. as programmed) includes a shaped housing 3 having an elongated channel formed of an input funnel 4, a conveying channel 5, and an output funnel 6 for the passage of the yarn 1. The conveying channel 5 passes through a treatment station 11 in which a treatment medium 9, such as a liquid dye, is applied to the yarn 1. The housing 3 also has a supply channel 7 in the middle which is set perpendicularly to the conveying channel 5 and treatment station 11. This supply channel 7 has an outlet at the treatment station 11 for supplying the treatment medium 9 which is supplied via a conduit 17 into the channel through a nozzle 8 which opens into the supply channel 7. The supply channel 7 is also connected to a suitable source of compressed air (not shown) so that the nozzle 8 may eject the treatment medium 9 into a flow of compressed air 20 prior to entry into the treatment station 11.

In addition, the housing 3 has a pair of funnel-shaped annular channels **13*a*, 14*a* which are disposed upstream and downstream, respectively, of the treatment station 11 relative to the travelling yarn 1. Each of the channels 13*a*, 14*a* communicates with a stub 13, 14** through which compressed air may be supplied. Also, an exhaust channel 12 is set perpendicularly to the conveying channel 5 and treatment station 11 for removing excess treatment material and air from the station 11.

As shown, the upstream funnel-shaped channel 13*a* is disposed concentrically of the conveying channel 5 and has an outlet at the apex which is located at the outlet of the supply channel 7. This channel 13*a* functions so as to deliver compressed air at a pressure and rate sufficient to seal the conveying channel 5 upstream of the treatment station 11 against the treatment material. The downstream funnel-shaped channel 14*a* likewise is concentric to the channel 5 and has an outlet at the apex which is located at the outlet of the supply channel 7. This channel 14*a* functions so as to deliver compressed air circumferentially of the yarn 1 at a pressure and rate sufficient to remove excess treatment material which clings to the yarn 1 for removal via the exhaust channel 12. The downstream channel 14*a* is of particular importance for programmed dyeing since the channel 14*a* allows clean well-defined dyed places 26 in the yarn 1. At the same time, the channel 14*a* ensures that the treatment medium 9 passing from the supply channel 7, does not smear over the yarn 1 in the treatment station 11. Thus, after passing through the treatment station 11 in an uncontrolled manner, the emerging yarn 1 may be further dyed by other (means now shown) in the clean undyed sections between the dyed sections 26.

Figure 2:
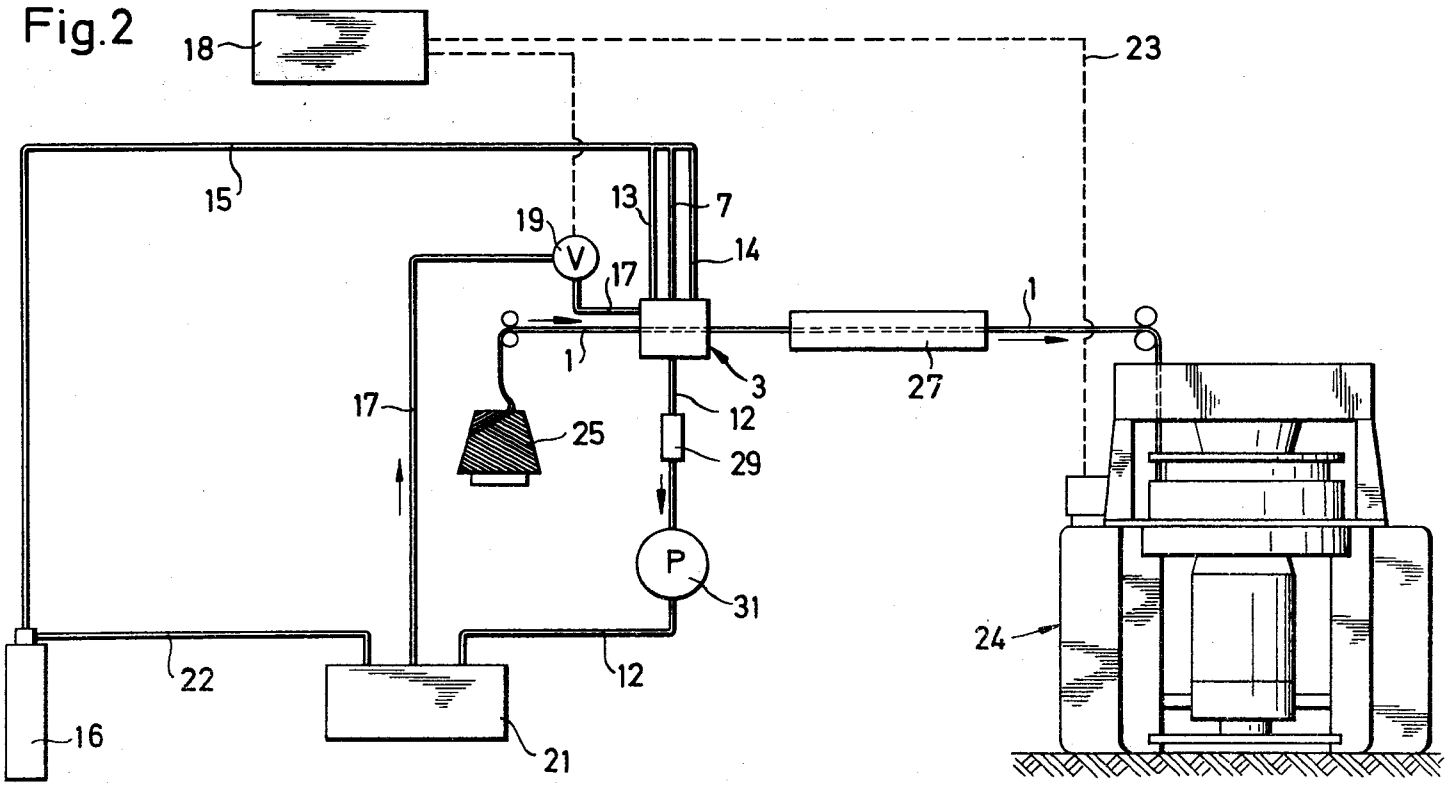
FIG. 2 illustrates the application of an apparatus of the invention to a knitting machine.

Referring to FIG. 2, wherein like reference characters indicate like parts as above, the dyeing apparatus includes a source of compressed air 16 which is connected via a common line 15 to the three stubs of the channels 13, 7, 14 so as to deliver a constant air flow. The conduit 17 for the nozzle 8 (not shown) is connected to a tank 21 for the treatment medium (i.e. dye) and has a control valve 19, e.g. a magnetic valve, therein which is operated by an electronic control means 18. The tank is also connected by a line 22 to the source 16 of compressed air, so that the introduced dye is under pressure. The pressure of the dye in the conduit 17 is made, for example, somewhat higher than the pressure of the constant air-flow 20 in the channels 13, 13*a*, 7, 14, 14*a*, so that a full compact column of liquid is produced in the lower end of the supply channel 7. The exhaust channel 12, as shown by FIG. 2, contains a filter 29 and a return-flow pump 31 through which the excess dye is returned to the tank 21.

The control means 18, as indicated by the dotted-line we is synchronized with a circular knitting machine 24, so that the yarn 1, running continuously from a supply-spool 25 through the shaped housing 3 into the machine to be knitted, can for example be given dyed lengths 26 (FIG. 1). In this way, it is possible to obtain a certain patterning of the knit goods produced in the knitting machine 24. The yarn may also be conducted through additional elements between the housing 3 and the knitting machine 24, e.g. through a fixing device 27 in which the dye becomes especially fixed.

Figure 3:
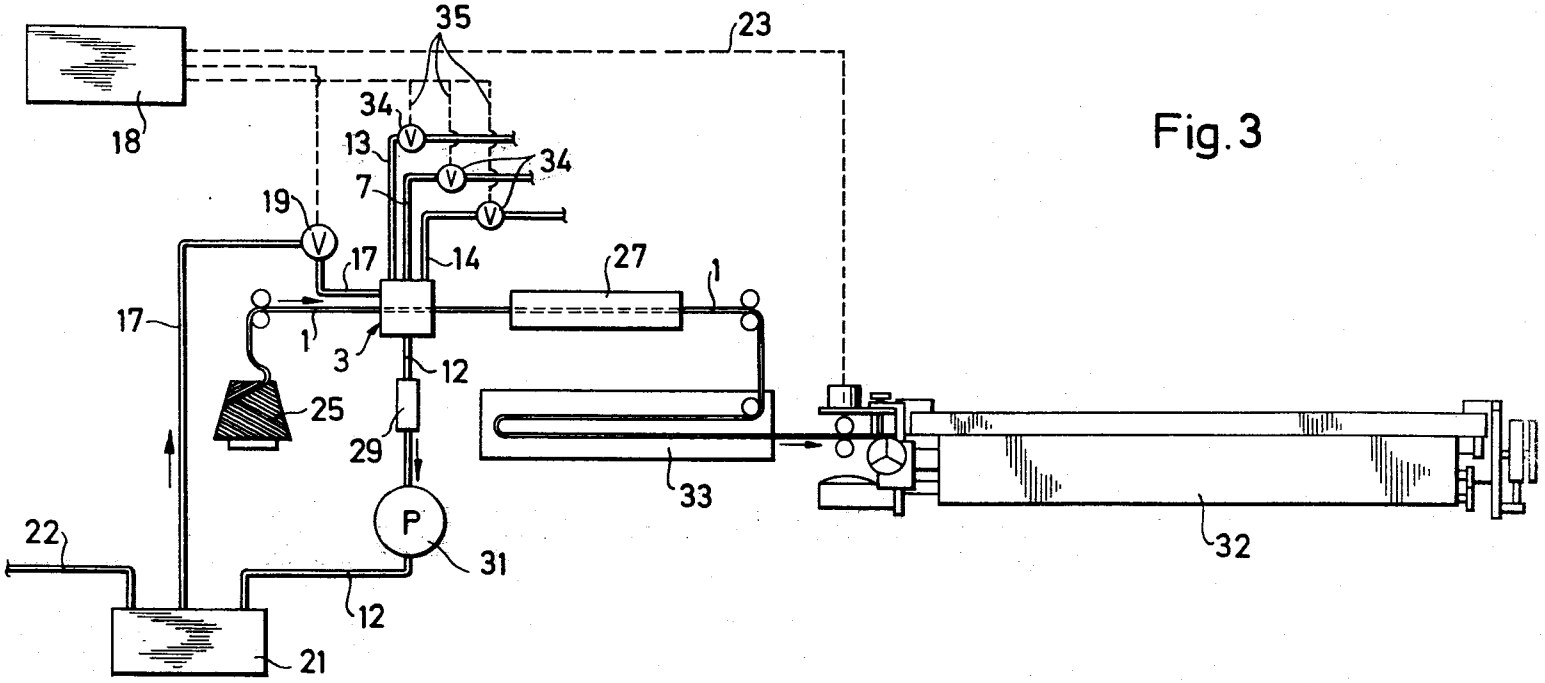
FIG. 3 illustrates the application of an apparatus of the invention to a loom.

Referring to FIG. 3, the dyeing apparatus may also be associated with a loom 32. As shown, the dyed yarn, after running through the fixing device 27, enters the schematically-indicated weft-thread storage 33, from which the yarn is intermittently withdrawn for insertion as a weft yarn into the loom-shed, while continuously running through the dyeing housing 3.

In this example, it is assumed that the channels 13, 7, 14 have controlled shut-off valves 34, so that the supplied compressed air can be switched on intermittently and only when required. The control valves 34 are each connected by lines 35 with the control device 18.

Figure 4:
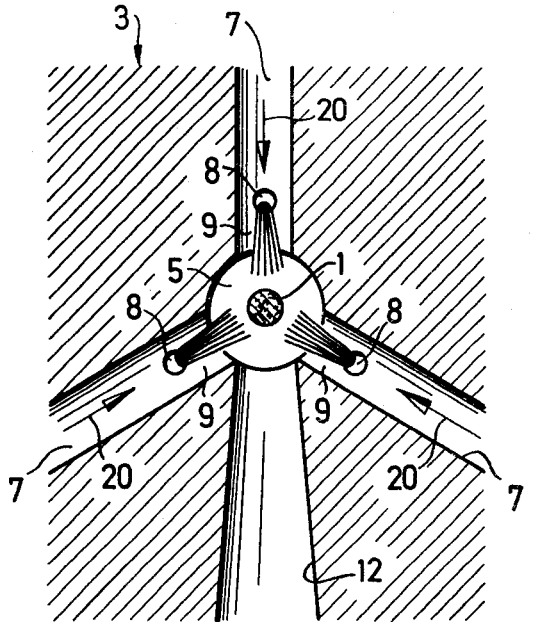
FIG. 4 illustrates a vertical section through a form of modified construction of an apparatus according to the invention.

Referring to FIG. 4, wherein like reference characters indicate like parts as above, instead of using one supply channel for the treatment medium, three supply channels 7, uniformly distributed round the periphery, are associated with nozzles 8 for delivering the medium to the yarn 1 in the treatment station.

Instead of a dye-liquid, other treatment mediums may be considered, for example for impregnating or fixing, such medium being introduced through the nozzles 8. The treatment medium may also be in powder or gaseous form. Instead of yarn, the treated strip may be made of polypropylene, metal wire, glass fibers and so forth.

With the example of FIG. 1, the dyeing liquid is sent unsprayed through the nozzle 8, i.e. without any infection action, into the supply channel 7, and the liquid forming below the nozzle 8 in channel 7 is conducted under the pressure of the air introduced into channel 7, downward upon the yarn 1. The yarn in the treatment station 11 is then covered on all sides by dye-liquid drops, so that the yarn is dyed into its interior. The compressed air out of the channels 13*a*, 7, 14*a*, serves to carry away the excess liquid in the channel 12.

The treatment apparatus may also be by it itself, for example for the patterned dyeing of a suitable material. Here, the material may run through the housing 3 continuously or intermittently.

The treatment apparatus may also be modified so that at least the air-flow in the supply channel 7 is controlled rhythmically with the treatment program or dyeing program. In this case, the dyeing liquid is sucked by the air flow through a nozzle and conducted to the treatment place 11.

Also, in a further embodiment the dyeing medium may be sucked in through the nozzle 8 by a vacuum. In this case, the exhaust or outflow channel 12 is also advantageously under a vacuum.

It is noted that if the channels 13*a*, 14*a* are omitted, the patterning will not be sharply defined but instead a random patterning with confused transitions between the dyed and undyed sections of the thread will be produced.

It is also noted that it is possible to dispose a number of housings 3 in succession in the direction in which the yarn runs, so that the yarn is, for example first dyed blue, with red then following, and with green finally. The individual dyeing apparati are then controlled by the control device 18 in such a way that separated colored sections of the thread 1 are produced.

What is claimed is:

1. An apparatus for dyeing a travelling strip having a conveying channel for passage of the strip through a predetermined treatment station;

at least one supply channel having an outlet for supplying a treatment medium to said station in a programmed manner; and at least one channel downstream of said treatment station relative to the travelling strip and concentric to said conveying channel for supplying compressed air to said treatment station circumferentially of the strip for removing excess treatment medium from the strip.

2. An apparatus as set forth in claim 1 which further comprises a channel at said treatment station for supplying compressed air to said station and a nozzle opening into said supply channel for expelling the treatment medium into said supply channel.

3. An apparatus as set forth in claim 2 further comprising an exhaust channel for removing excess treatment material and air from said station.

4. An apparatus as set forth in claim 3 which further comprises a pump connected to said exhaust channel for removing the treatment material and air under a suction force.

5. An apparatus as set forth in claim 1 which further comprises at least one channel upstream of said station for supplying compressed air to said station for sealing the first said channel against the treatment medium upstream of said station.

6. An apparatus for dyeing a travelling strip comprising an elongated channel for conducting the travelling strip through a treatment station;

a supply channel disposed perpendicularly of said elongated channel and having an outlet at said station for supplying a treatment medium thereto;

a funnel-shaped annular channel upstream of said station having an outlet at the apex thereof and at said outlet of said supply channel for supplying compressed air to seal said elongated channel upstream of said station against the treatment medium;

a funnel-shaped annular channel downstream of said station having an outlet at the apex thereof and at said outlet of said supply channel for supplying compressed air to said station; and an exhaust channel perpendicular to said elongated channel at said treatment station for removing excess treatment material and air from said station, said exhaust channel having an inlet disposed between said outlets of said funnel-shaped annular channels.

7. An apparatus as set forth in claim 6 which further comprises a means for supplying compressed air to said supply channel, a conduit for supplying treatment medium to said supply channel and a nozzle in said conduit for ejecting the treatment material into a flow of compressed air in said supply channel.

8. An apparatus as set forth in claim 7 which further comprises a supply tank connected to said conduit for supplying treatment material thereto and a control valve for regulating the amount of treatment material supplied from said tank to said conduit.

9. An apparatus as set forth in claim 8 which further comprises a control means connected to said valve for operating said valve in a programmed manner.

10. An apparatus as set forth in claim 6 which further comprises a means for supplying a constant flow of compressed air to said supply channel and said funnel-shaped channels.

11. An apparatus as set forth in claim 6 which further comprises means for supplying compressed air to said supply channel and said funnel-shaped channels, and at least one valve for regulating the flow of compressed air to at least one of said latter channels.

12. An apparatus for dyeing a travelling strip comprising a housing having a first channel for conducting the travelling strip through a predetermined treatment station therein, at least one supply channel having an outlet at said treatment station for supplying a treatment medium to said station, at least one channel downstream of said treatment station relative to the travelling strip and concentric to said first channel for supplying compressed air to said station and an exhaust channel in communication with said station for removing excess treatment medium and air therefrom; and means for supplying the treatment medium to said supply channel at said station to dye a portion of the strip thereat.

13. An apparatus as set forth in claim 12 wherein said air supply channel is a funnel-shaped annular channel disposed concentrically of said elongated channel and having an outlet at the apex facing said station.

* * * * *